United States Patent [19]

Wanless

[11] 4,000,059

[45] Dec. 28, 1976

[54] HYDROCARBON SEPARATION PROCESS

[75] Inventor: Gordon James Wanless, Lightwater, England

[73] Assignee: The British Petroleum Company Limited, London, England

[22] Filed: Mar. 14, 1975

[21] Appl. No.: 558,234

[30] Foreign Application Priority Data

Mar. 20, 1974 United Kingdom ..... 12335/74

[52] U.S. Cl. ..... 208/310 Z; 260/676 MS

[51] Int. Cl.[2] ..... C10G 25/04

[58] Field of Search ..... 208/310 Z; 260/676 MS

[56] References Cited

UNITED STATES PATENTS

| | | | |
|---|---|---|---|
| 3,227,647 | 1/1966 | Krane | 208/310 Z |
| 3,753,895 | 8/1973 | Francis | 208/310 Z |

*Primary Examiner*—Herbert Levine

*Attorney, Agent, or Firm*—Morgan, Finnegan, Pine, Foley & Lee

[57] ABSTRACT

In a 5A molecular sieve separation process for the production of n-paraffins the amount of feed required to produce a given amount of n-paraffins is reduced by recycling all of the effluent from the adsorber for a certain period during the adsorption stage.

7 Claims, No Drawings

HYDROCARBON SEPARATION PROCESS

This invention relates to a cyclic process for the separation of n-paraffins from mixtures thereof together with non straight chain hydrocarbons e.g. cycloparaffins and isoparaffins using a bed of 5A molecular sieve.

The separation of n-paraffins from non straight chain hydrocarbons using a 5A molecular sieve has been previously described e.g. UK Patent Nos. 944,441 and 1,026,116.

In such a process only the n-paraffins are able to enter the pores of the sieve and when a feed mixture containing n-paraffins in admixture with branched chain and cyclic paraffins is passed through the bed of the sieve, the branched chain and cyclic paraffins come out in the effluent and the n-paraffins are adsorbed. The n-paraffins are subsequently removed in a separate stage called a desorption stage.

Thus, two products are obtained from a molecular sieve separation process namely, the n-paraffins which are the effluent from the desorption stage and the non straight chain hydrocarbons (denormal product) which are the effluent from the adsorption stage. When the feed mixture is a kerosine or gas oil the desired product is usually the n-paraffins but when the feed mixture is a gasoline the desired product is usually the relatively high octane non normal hydrocarbons and the process is usually operated to maximise the yield of the desired product.

An invention has now been made which enables either the amount of feed needed to produce a given amount of n-paraffins to be reduced or the purity of the n-paraffins or the denormal product to be improved.

According to the present invention a cyclic vapour phase process for separating n-paraffins boiling in the gasoline, kerosine or gas oil ranges from a feed mixture thereof with non-straight chain hydrocarbons by means of a bed of 5A molecular sieve comprises (i) an adsorption stage in which the feed mixture is passed into the bed to produce an effluent from the bed from which the n-paraffins have been at least partly removed and, when from 70 to 140% of the total feed mixture (as hereinafter defined) has been passed into the bed, the effluent is recycled to the feed mixture and (ii) a desorption stage which comprises desorbing the n-paraffins from the bed.

By the term "total feed mixture" we mean the amount of feed mixture that would be passed into the bed from commencement of the adsorption stage to the breakthrough point. The "breakthrough" point is indicated by a sharp increase in the amount of n-paraffins in the effluent.

Preferably the recycle is commenced when from 80 to 100% of the total feed mixture has been passed into the bed.

When recycling of the effluent has been commenced it is preferably continued until the end of the adsorption stage (the adsorption stage starts with the passing of the feed mixture into the bed and ends when the feed mixture is cut off).

Preferably the recycled effluent is not passed back immediately into the bed but passed to the feed mixture in a reservoir and allowed to blend therewith.

The effluent from the bed during the adsorption stage from the start of the stage up until the start of the recycle is, in the case of feed mixtures in the gasoline range, preferably collected as denormal product.

Preferably the feed mixture is passed at a constant rate, so the amount of feed mixture passed into the bed is proportional to the time for which the feed mixture is passed.

Regardless of whether the feed mixture is a gasoline, kerosine or gas oil range material it is preferred to continue to pass the feed mixture into the bed at least until the breakthrough point is reached.

When the feed is a gasoline range mixture the object is usually to obtain a relatively high octane non normal hydrocarbon product and it has been previously proposed to cut off the feed mixture before the breakthrough point is reached. With the present invention this is not necessary because contamination of the adsorption stage effluent with n-paraffins is avoided. In addition the normal paraffin product is of high purity.

Since the process is performed in a cyclic manner, the adsorption stage of one cycle follows immediately after the desorption stage of a preceding cycle. When desorption is effected by pressure reduction the pressure in the bed at the start of the adsorption stage is, therefore, very low and a first part of the adsorption stage is preferably carried out as a pressurising up step by passing the feed mixture into the bed but keeping the outlet valve(s) closed.

When the feed mixture is a gas oil or kerosine a first part of the adsorption stage effluent is preferably not collected as product but is also recycled to the feed mixture. This recycle is hereafter referred to as the "first recycle". Preferably less than 20% of the total effluent from commencement of feed to breakthrough is recycled in this first recycle more preferably less than 10%. Preferably this first recycle is started at the end of the pressurising up step.

The desorption can be effected by a desorbing medium, e.g. n-pentane as described in UK Patent No. 944,441, or preferably by reducing the pressure as described for example in UK Patent No. 1,026,116.

In the same case of gas oil and kerosine the pressure reduction can be effected by direct condensation as described in UK Patent No. 1,110,494 and in the case of gasoline by use of an ejector as described in our French Patent No. 7425509.

The general process conditions e.g. temperatures, pressures, durations of the various stages and operating procedures can be as described in the above mentioned patents.

The process temperature preferably lies within the range 300°–450° C, and preferred temperatures for different range feedstocks are 325°–375° C for gasoline, 350°–400° C for kerosine, and 380°–420° C for gas oil.

The adsorption stage is desirably operated at a maximum pressure of 3–150 psia, the preferred pressure varying with feedstock being 40–100 psia for gasoline, 15–35 psia for kerosine, and 5–30 psia for gas oil.

A purge stage can be interposed between the adsorption and desorption stages. When the purge is effected by pressure reduction, the final purge pressure can be within the range 0.1–25 psia, the preferred pressure also depending upon the actual boiling range of the feedstock. For example, when treating a gasoline fraction of average carbon number about $C_7$ boiling in the range $C_4$–180° C a purge pressure range of 2–10 psia is preferred, while 0.3–3.0 psia is preferred for kerosine range fractions of average carbon number about $C_{11}$ boiling between 150°–250° C, and 0.1–1.0 psia for gas oil fractions and higher boiling fractions ranging between 200°–450° C. Similarly, when desorbing by pressure reduction, the final desorption pressure can be within the range 0.05–2.0 psia, the preferred pressure varying according to the feedstock boiling range preferably 0.2–2.0 psia for gasoline, 0.07–0.3 psia for kerosine and 0.05–0.3 psia for gas oil fractions.

When purging is by pressure reduction the purge duration should preferably not exceed 3 minutes, less than 1 minute being preferred. The adsorption and desorption durations can be respectively, 1–5 preferably 1–3 minutes and 1–10 preferably 1–8 minutes.

EXAMPLE 1

A hydrofined gas oil boiling in the range 260°–350° C and containing 56% wt. of n-paraffins, and a sulphur content of 100 ppm was processed cyclically under the conditions given in Table 1.

Table 1

| Stage | Duration | Temperature | Pressure at end of stage | Feed rate (fresh feed) pounds/hour |
|---|---|---|---|---|
| Adsorption | 90 secs. | 400 ° C | 1000 mmHg | 63188 (225,670 tons/year) |
| Purge | 90 secs. | 400 ° C | 20 mmHg | — |
| Desorption | 270 secs. | 400 ° C | 2 mmHg | — |

The sieve was a 5A sieve, consisting of 4–8 mesh beads and was contained in five adsorbers each 34 feet long and 11 feet in diameter and containing 53 tons of sieve.

For the first 30 seconds of the adsorption stage the bed was pressured up from 2 mmHg to 1000 mmHg. At this pressure the outlet valve from the bed was opened and effluent was collected and recycled to the feed mixture reservoir for the next 5 seconds and allowed to blend therewith. Then for 45 seconds the effluent was collected as product of about 0.5% wt n-paraffin content; and finally for 10 seconds the effluent was collected and recycled to the feed mixture reservoir and allowed to blend therewith. During this latter period breakthrough occurred. At the end of the 10 seconds recycle period the composition of the effluent was the same as the feed mixture.

The bed was then purged and the purge effluent recycled to the feed mixture reservoir and the bed then desorbed by direct condensation of the effluent using as a quench liquid condensed desorption effluent from a previous stage as described in UK Patent No. 1,110,494. Using this procedure the amount of fresh feed to produce 128,458 tons/annum of 98.0% wt purity n-paraffins was 225,670 tons. The amount of denormal product of 0.5% wt n-paraffin content was 97,212 tons/annum.

EXAMPLE 2

This example was carried out exactly as described in Example 1 with the exception that the first recycle was omitted, and the effluent during the 5 second period collected as product. The yield of n-paraffins was 128,428 tons per year i.e. 30 tons less than in Example 1. The purity of the n-paraffin product was unchanged. The amount of denormal product was increased by 30 tons of n-paraffins but the purity was marginally lower on account of this extra 30 tons of n-paraffins contained therein.

EXPERIMENT A

This experiment is not according to the invention and is included for comparative purposes only. The process was carried out exactly as described in Example 1 except that the effluent from the adsorption stage was not recycled but collected as denormalised product. The denormalised product contained 7.5% wt n-paraffins. Using this procedure the amount of feed required to obtain 128,458 tons/annum of n-paraffins of 98% wt purity was 239,676 tons. The amount of denormal product was 111,218 tons/annum.

Comparison of Example 1 with experiment A shows how, by operating according to the invention, and recycling the effluent from the adsorption stage the efficiency of the process can be improved and a given amount of n-paraffins obtained from a smaller amount of feed.

EXAMPLE 3

A hydrofined gas oil boiling in the range 260° to 350° C and containing 30% wt n-paraffins, and a sulphur content of 100 ppm was processed cyclically under the conditions given in Table 2.

Table 2

| Stage | Duration | Temperature | Final Pressure | Feed Rate (Fresh Feed) Pounds/hour |
|---|---|---|---|---|
| Adsorption | 90 secs. | 400° C | 1000 mmHg | 97871 (349540 tons/year) |
| Purge | 90 secs. | 400° C | 20 mmHg | — |
| Desorption | 270 secs. | 400° C | 2 mmHg | — |

The example was effected as described in Example 1 above except the length of each of the five adsorbers was 27 feet and contained 43 tons of sieve. The denormal product obtained was 243,782 tons/year containing 0.5% wt of n-paraffins and the n-paraffin product 105,758 tons/year containing 98% wt n-paraffins.

EXPERIMENT B

This experiment is not according to the invention and is included for comparative purposes only. The process was carried out exactly as described in Example 3 except the effluent from the adsorption stage was not recycled but collected as denormal product containing 4.2% wt n-paraffins. Using this procedure the amount of feed required to obtain 105,758 tons/annum of n-paraffin product of 98.0% wt purity was 384,490 tons. The amount of denormal product was 278,732 tons.

Comparison of Example 3 and Experiment B shows how, by operating according to the invention, and recycling the effluent from the adsorption stage the efficiency of the process can be improved and a given amount of n-paraffins obtained from a smaller amount of feed.

EXAMPLE 4

The following gasoline feed was used (% wt):

| | | |
|---|---|---|
| n-Paraffins | | |
| Propane | 0.1 | 24.7 |
| n-Butane | 1.2 | |
| n-Pentane | 16.8 | |
| n-Hexane | 6.6 | |
| Iso-Paraffins | | |

-continued

| | | |
|---|---|---|
| Isobutane | 0.8 | |
| Isopentane | 31.7 | |
| 2,2-Dimethylbutane | 10.8 | 69.5 |
| 2,3-Dimethylbutane | 4.1 | |
| 2-Methylpentane | 14.0 | |
| 3-Methylpentane | 8.1 | |
| Cyclo-Paraffin | | |
| Cyclopentane | 1.5 | |
| Methylcyclopentane | 2.2 | 5.8 |
| Cyclohexane | 2.1 | |
| Sulphur content ppm | 1.3 | |
| Specific gravity g/ml | 0.6506 | |

The feed was processed with 5A molecular sieve, (4.8 mesh beads, 9060 grams, 12070 mls) using the following cyclic conditions at 360° C:

| | | |
|---|---|---|
| Adsorption Stage | | |
| Duration | s | 140 |
| Final pressure bar | (abs) | 7.9 |
| Rate | mls/s | 10 |
| Purge Stage | | |
| Duration | s | 90 |
| Final pressure bar | (abs) | 1.01 |
| Desorption Stage | | |
| Duration | s | 240 |
| Final pressure mm Hg | (abs) | 165 |

During the first 30 seconds of the feed stage the adsorber was pressured up from 165 mm Hg (abs) to 7.9 bar (abs), the outlet valve was then opened and the effluent recovered for 50 seconds as a denormal product of 97.2 per cent weight purity (i.e. 2.8% n-paraffins). Thereafter for the remaining 60 seconds of the adsorption stage the effluent was recycled to the feed mixture reservoir and allowed to blend therewith. During this time breakthrough occurred. Purge and desorption were then effected as described in our French Patent 7425509. The entire purge effluent was recycled to the feed mixture reservoir. The desorption effluent contained 94.9% wt n-paraffins.

EXPERIMENT C

This experiment was performed exactly as in Example 4 except that the adsorption stage was conducted for 80 seconds only i.e. the 60 second recycle was omitted entirely. Breakthrough did not occur.

The effluent was collected as a denormalised product of 97.2% purity (i.e. 2.8% wt n-paraffins). Purge and desorption were then effected, the desorption effluent contained 93.3% wt n-paraffins.

EXPERIMENT D

This experiment was performed exactly in Example 4 except that in the adsorption stage the effluent was not recycled but the entire effluent collected as denormalised product containing 5% wt n-paraffins.

The product from the desorption stage contained 94.9% wt n-paraffins.

Comparison of Example 4 with Experiment D shows how by operating according to the invention and recycling part of the effluent from the adsorption stage, the purity of the denormal product can be increased from 95 to 97.2% wt, and with Experiment C shows how by operating the recycle at the end of the adsorption stage the purity of the n-paraffin product can be improved from 93.3 to 94.9% wt.

I claim:

1. A cyclic vapour phase process for separating n-paraffins boiling in the gasoline, kerosine, or gas oil ranges from a feed mixture thereof with non straight chain hydrocarbons at a temperature in the range 300° to 450° C. by means of a bed of 5A molecular sieve which process comprises i. an adsorption stage in which the feed mixture is passed into the bed to produce an effluent from the bed from which the n-paraffins have been at least partly removed, and recycling all of the effluent from the adsorption stage for a certain period of time during the adsorption stage, said period commencing when at least 70% of the total feed mixture has been passed into the bed and ending when not more than 140% of the total feed mixture has been passed into the bed;

ii. a desorption stage which comprises desorbing the n-paraffins from the bed.

2. A cyclic vapour phase process as claimed in claim 1 wherein the recycle is commenced when from 80 to 100% of the total feed mixture has been passed into the bed.

3. A cyclic vapour phase process as claimed in claim 1 wherein when the recycle has been commenced it is continued until the end of the adsorption stage.

4. A cyclic vapour phase process as claimed in claim 1 wherein the recycled effluent is passed to the feed mixture in a reservoir and allowed to blend therewith.

5. A cyclic vapour phase process as claimed in claim 1 wherein when the feed mixture is a kerosine or gas oil, at least part of the first 20% of the effluent from the bed after the commencement of the adsorption stage is recycled to the feed mixture.

6. A cyclic vapour phase process as claimed in claim 5 wherein at least part of the first 10% of the effluent is recycled to the feed mixture.

7. A cyclic vapour process as claimed in claim 6 in which desorption is effected by pressure reduction and at the commencement of the adsorption stage the bed is pressurised up to a pressure which is maintained for the remainder of the stage and the recycle is started at the end of the pressuring up.

* * * * *